235-379 SR
8/14/84 XR 4,465,192

United States Patent [19]

Ohba et al.

[11] Patent Number: 4,465,192

[45] Date of Patent: Aug. 14, 1984

[54] APPARATUS FOR PROCESSING PAPER SHEETS

[75] Inventors: Hiroshi Ohba; Shigeo Horino, both of Tokyo, Japan

[73] Assignee: Tokyo Shibaura Denki Kabushiki Kaisha, Kawasaki, Japan

[21] Appl. No.: 400,405

[22] Filed: Jul. 21, 1982

[30] Foreign Application Priority Data

Sep. 17, 1981 [JP] Japan ..... 56-146591

[51] Int. Cl.[3] ..... B07C 5/38; B65H 31/26

[52] U.S. Cl. ..... 209/534; 235/379; 271/3.1; 271/9; 271/166

[58] Field of Search ..... 209/534, 551; 235/379; 271/3.1, 4, 9, 165, 166, 217-219, 291; 194/4 R, 4 B-4 G

[56] References Cited

U.S. PATENT DOCUMENTS

| | | | |
|---|---|---|---|
| 3,378,251 | 4/1968 | Donabin | 271/9 X |
| 3,795,395 | 3/1974 | Ransom et al. | 271/163 X |
| 3,800,155 | 3/1974 | Potenza | 209/534 X |
| 3,930,581 | 1/1976 | Gray | 209/534 |
| 4,157,822 | 6/1979 | Miller | 271/9 X |
| 4,398,088 | 8/1983 | Hirose et al. | 235/379 |

FOREIGN PATENT DOCUMENTS

| | | | |
|---|---|---|---|
| 54-51598 | 4/1979 | Japan | 209/534 |
| 54-111893 | 9/1979 | Japan | 209/534 |
| 54-113399 | 9/1979 | Japan | 209/534 |
| 55-91089 | 7/1980 | Japan . | |
| 55-119774 | 9/1980 | Japan . | |

*Primary Examiner*—Robert B. Reeves
*Assistant Examiner*—Edward M. Wacyra
*Attorney, Agent, or Firm*—Cushman, Darby & Cushman

[57] ABSTRACT

Paper sheets, which are loaded in a supply section without any regard to which direction their first or second surface is facing, are supplied to a detecting section for checking as to whether the first surface is facing in a preselected direction and also for identifying the kind of paper sheet. The paper sheets supplied with their first surface facing in the preselected direction are sorted and stacked in first stacking sections in accordance with the kind of paper sheet. The paper sheets of all kinds supplied with their second surface facing in the preselected direction are stacked in a single second stacking section. Each of the paper sheets stacked in the second stacking section are supplied with their first surfaces facing in the preselected direction to the detecting section, again for identification of the kind, once again.

16 Claims, 11 Drawing Figures

FIG. 7A

| | |
|---|---|
| RECEPTION | TOTAL AMOUNT |
| | ¥ 10,000 |
| | ¥ 5,000 |
| | ¥ 1,000 |
| | ¥ 500 |
| DELIVERY | TOTAL AMOUNT |
| | ¥ 10,000 |
| | ¥ 5,000 |
| | ¥ 1,000 |
| | ¥ 500 |
| STACKING OF NOTES OF THE SAME CURRENCY VALUE | ¥ 10,000 |
| | ¥ 5,000 |
| | ¥ 1,000 |
| | ¥ 500 |
| STACKING OF DAMAGED NOTES | TOTAL AMOUNT |
| | ¥ 10,000 |
| | ¥ 5,000 |
| | ¥ 1,000 |
| | ¥ 500 |

FIG. 7B

| | |
|---|---|
| STACKING OF BACK-SIDE NOTES | TOTAL AMOUNT |
| | ¥ 10,000 |
| | ¥ 5,000 |
| | ¥ 1,000 |
| | ¥ 500 |
| TEMPORARY STACKING OF NOTES OF THE SAME CURRENCY VALUE | ¥ 10,000 |
| | ⋮ |
| TEMPORARY STACKING OF DAMAGED NOTES | ¥ 10,000 |
| | ⋮ |
| TEMPORARY STACKING OF BACK-SIDE NOTES | ¥ 10,000 |
| | ⋮ |
| PAYMENT | TOTAL AMOUNT |
| | ¥ 10,000 |
| | ¥ 5,000 |
| | ¥ 1,000 |
| | ¥ 500 |
| NON-COINCIDENCE OF SORTED BACK-SIDE NOTES | |
| | ⋮ |

APPARATUS FOR PROCESSING PAPER SHEETS

BACKGROUND OF THE INVENTION

This invention relates to an apparatus for processing paper sheets such as bank notes and securities, and more particularly to an apparatus which sorts paper sheets into stacks of like kinds thereof with each sheet having a predetermined surface facing in a predetermined direction, in preparation for distribution by the apparatus.

Where bank notes, for instance, are dealt with by this type of processing apparatus, it is desired that the bank notes be sorted into stacks of like kinds thereof and be distributed by the apparatus as desired. Further, it is desired that the bank notes be stacked in the individual stacks with the front or back surface facing a predetermined direction in preparation for distribution to a customer or an operator as desired. When loading the bank notes to be sorted, into the supply section of the apparatus, however, it is very time-consuming to prearrange them with the front or back surface facing a predetermined direction. Therefore, they are usually arranged in a stack without regard to whether their front or back surface is facing a predetermined direction. For this reason, the processing machine must have a function of rearranging the loaded bank notes such that their front or back surface is facing a predetermined direction as well as the sorting function.

However, no processing machine having these two functions, as well as being capable of processing a great deal of bank notes continuously and quickly, yet being compact construction, has ever been available.

Further, an apparatus, which can sort paper sheets according to different kinds thereof and reject damaged or defective paper sheets, is normally provided separately from an apparatus, which can deliver paper sheets in given amounts specified by customers, for instance, from an outlet slot. In other words, no single apparatus which can sort supplied paper sheets and deliver paper sheets as specified, has ever been available.

SUMMARY OF THE INVENTION

An object of the present invention is to provide an apparatus for processing paper sheets, which can quickly and continuously sort paper sheets into stacks of like kinds with each sheet having a predetermined surface facing a predetermined direction in preparation for distribution and which also is compact in construction.

In the paper sheet processing apparatus according to the invention, paper sheets loaded in a supply section without regard to whichever surface is directed to any side, are supplied to a detecting section for checking whether a predetermined side is facing in a preselected direction and also for discrimination of their kinds. The sorted paper sheets, which have their predetermined surface facing the preselected direction, are distributed into first stacking sections which are provided for the respective kinds of paper sheets. The remaining paper sheets regardless of kind, are collected in a single second stacking section. The paper sheets stacked in the second stacking section are again supplied to the detecting section, this time with their predetermined surfaces facing in the same direction, and are sorted once again.

With the above processing apparatus according to the invention, in which only paper sheets which are determined to already have a predetermined surface facing in a preselected direction are subjected to a sorting process, while the paper sheets found to have a surface other than the predetermined surface facing in the preselected direction are temporarily collected for subsequent rearrangement, a high processing speed can be ensured. In addition, paper sheets may be transferred smoothly and with less possibility of faulty transfer such as being caught on the transfer mechanism.

According to the present invention, the paper sheets that are stacked in the second stacking section can be continuously taken out and fed back to the detecting section for rearrangement by a return paper sheet transfer mechanism. This transfer mechanism may comprise rollers and conveyor belts. The mechanism also changes the position of the paper sheets during their transfer to the detecting section, so that the predetermined surface is facing the preselected direction. Thus, high speed and highly reliable sorting of the paper sheets can be expected.

Further, according to the present invention the first stacking sections can be connected, by take-out and feed means which may comprise rollers and conveyor belts, to a delivery paper sheet stacking section, connected to a delivery slot, so that the paper sheets, stacked in the first stacking sections by like kinds, may be transferred for delivery as specified by a customer or an operator. Thus, the processing apparatus according to this invention may have both a sorting function and a delivering function. These functions can be obtained concurrently. While the prior art sorting apparatus and delivering apparatus are provided as separate apparatus and require independent stacking section groups for arrangement, according to the invention only a single stacking section group may be used commonly.

The above and further objects, features and advantages of the invention will become more apparent from the description of a preferred embodiment thereof when the same is read with reference to the accompanying drawings.

BRIEF DESCRIPTION OF THE DRAWINGS

FIGS. 7A and 7B are views showing memory contents in a data memory.

DETAILED DESCRIPTION OF THE PREFERRED EMBODIMENT

Figure 1:
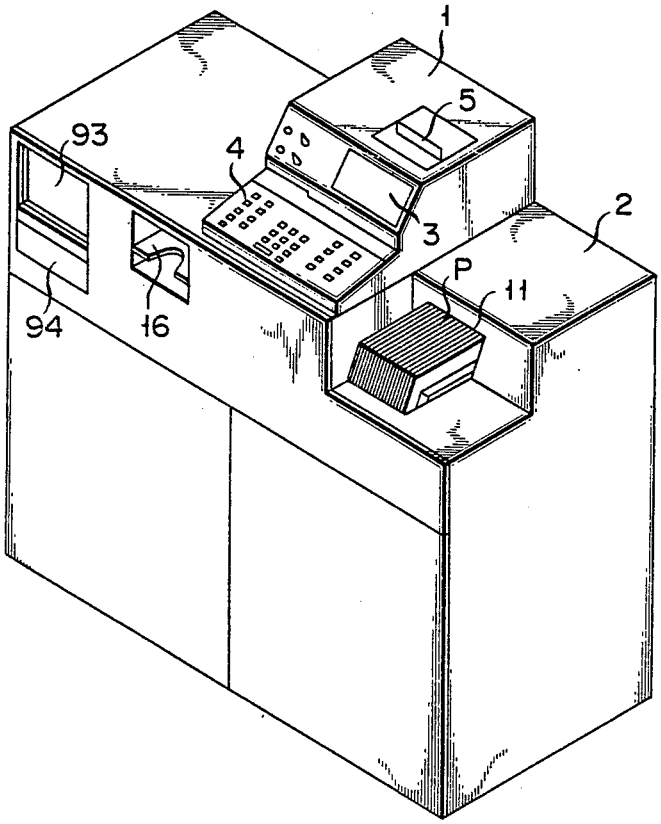
FIG. 1 is a perspective view showing an embodiment of the paper sheet processing apparatus according to the present invention.

A preferred embodiment of the invention will now be described with reference to the drawings. FIG. 1 shows a paper sheet processing apparatus according to the invention, which processes bank notes as paper sheets P. In this embodiment, bank notes issued by the Bank of Japan are used to explain the operation of the device.

Figure 2:
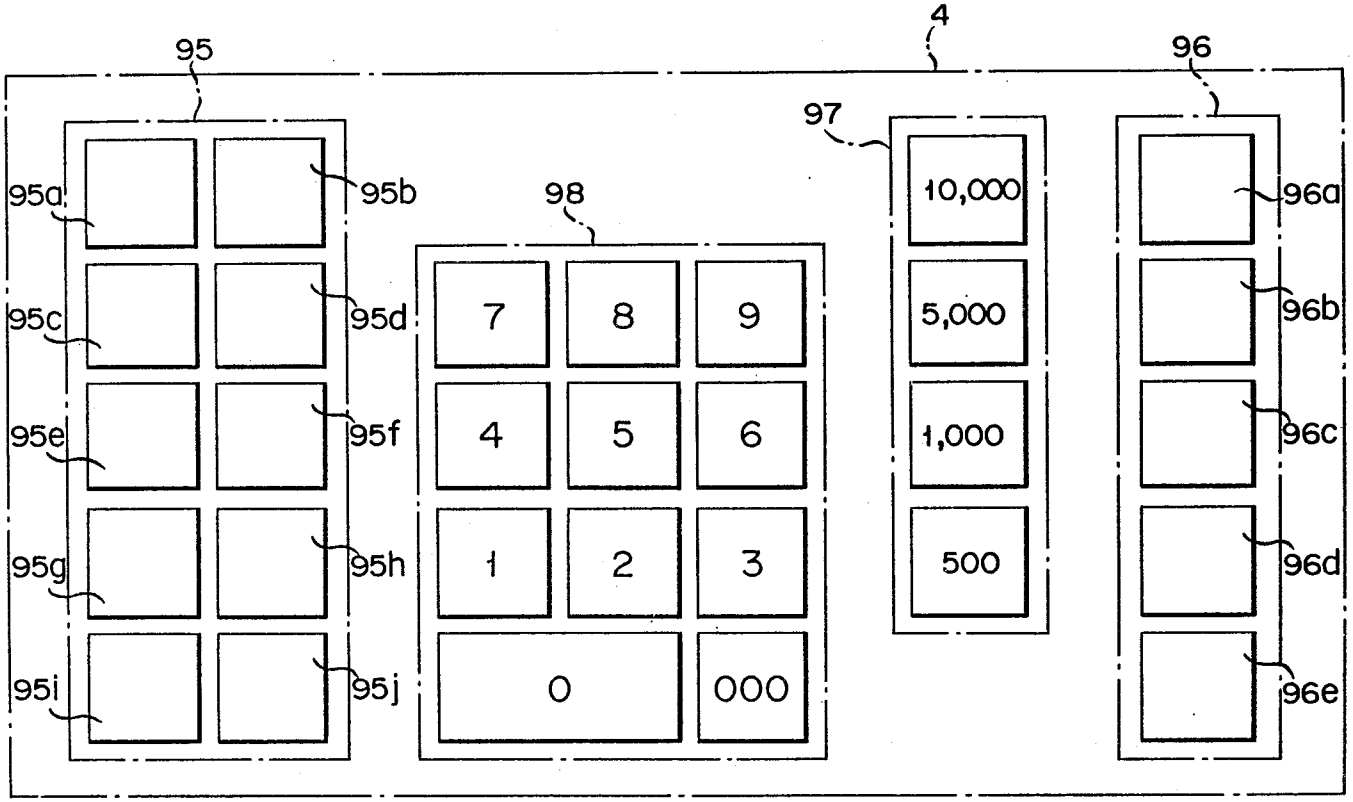
FIG. 2 is an enlarged-scale view showing a keying section in the apparatus of FIG. 1.

The apparatus can undertake a receiving process of counting and sorting received paper sheets (hereinafter referred to as bank notes or merely as notes), a backside note sorting process of sorting received bank notes which are stacked backside up (hereinafter also referred to as backside notes) according to their currency values, and a payment process of delivering the notes from the sorted note stacks according to data entered in an operating section 1. As shown in FIG. 1, the operating section 1 includes a display section 3, a keying section 4, which includes function key groups 95 and 96 having a reception key 95*a* and a payment key 95*b*, a denomination key group 97 and numeric keys 98 and a printing section 5 for printing such data as received amount and amount of payment. FIG. 2 shows the keying section 4 in detail. As is shown, the section includes the first function key group 95 which has the reception key and payment key, and the second function key group 96 which has a count start key and a count stop key, as well as the denomination key group 97 and numeric keys 98.

Figure 3:
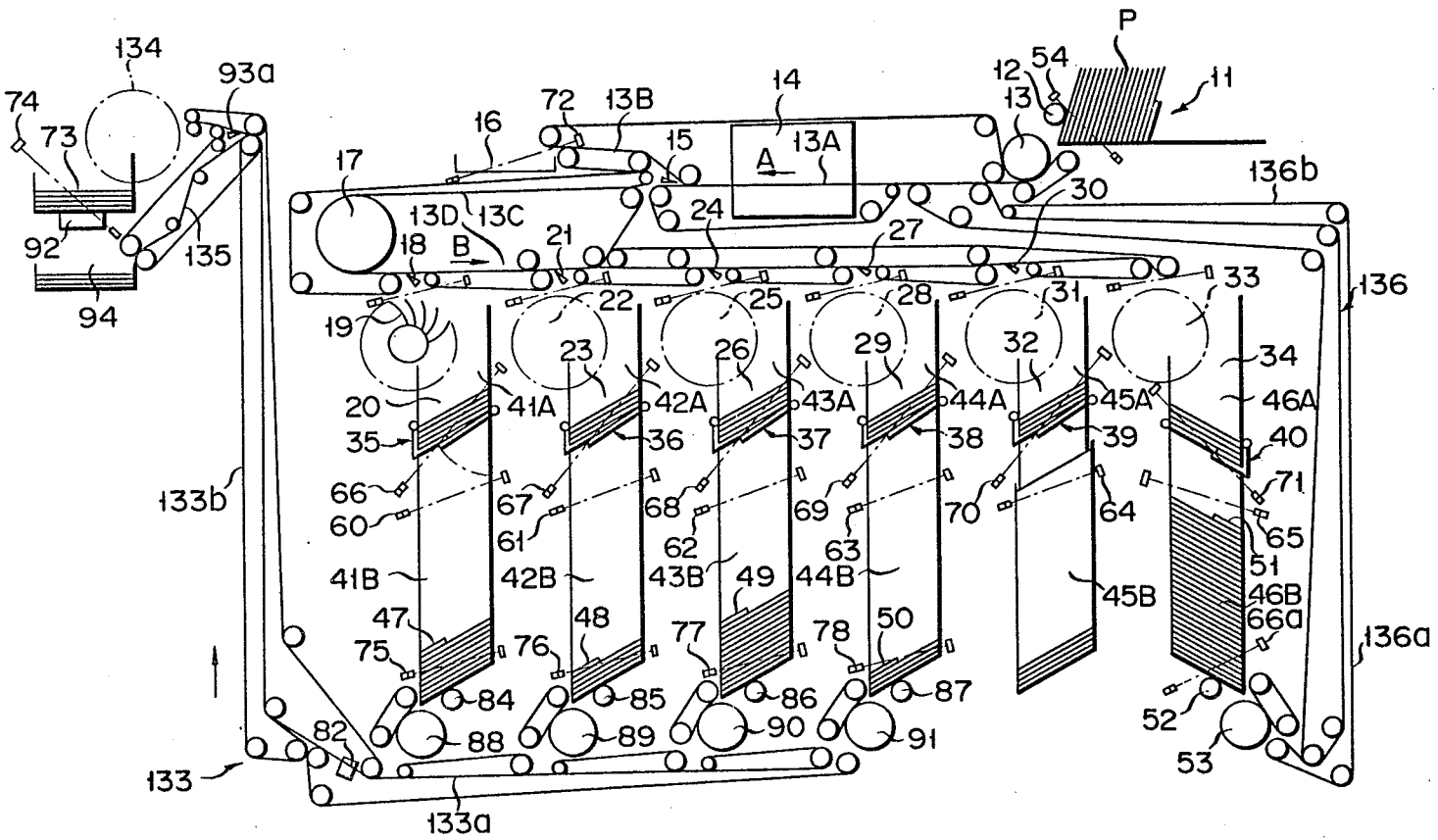
FIG. 3 is an enlarged-scale schematic sectional view showing the internal construction of the apparatus of FIG. 1.

FIG. 3 shows the internal construction of the paper sheet processing apparatus. A supply section 11 is provided at the right front top of the frame 2 (FIG. 1). In the supply section 11, bank notes as paper sheets P are stacked without regard to their currency values, to whether their front or back surface is directed forward and to whether they are orientated longitudinally or transversely. The bank notes P thus stacked in the supply section 11 are taken out therefrom one by one, starting from the leading one, by a take-out roller 12 into the apparatus 2 and fed out by a feed roller 13. The take-out roller 12 and feed roller 13 constitute a first take-out and feed device. A detector 54 which includes a light emitting element, for instance a lamp, and a photoelectric element is provided in the supply section 11 to detect the presence or absence of bank notes P in the section 11. A detecting section 14 is provided ahead of the feed roller 13, and determines the currency values of the notes P supplied to it on a belt conveyor 13A. The section 14 also checks whether the notes are supplied with the front or backside up whether the supplied notes are capable or incapable of re-use. The output of the detecting section 14 is supplied to a control section 114 which will be described later.

The bank notes P that have passed as processible bank notes through the detecting section 14 are further transferred on a belt conveyor 13B. Bank notes P that are determined to be incapable of processing by the detecting section 14, are led as rejected notes to a branch path 13A from a rejected note gate 15 which is provided on the main transfer path, and are collected in a rejected note collecting section 16. A detector 72 which includes a lamp or light emitting element and a photoelectric element is provided in the rejected note collecting section 16 to detect the presence or absence of rejected notes in the section 16. The bank notes P that are determined to be normal bank notes clear the rejected note gate 15 and are further transferred on a belt conveyor 13C where their direction is changed by the change roller 17 to the direction of arrow B. The bank notes P are then transferred on a transfer path 13D, which extends horizontally and substantially parallel to the belt conveyor 13C.

Disposed at a suitable spacing along the transfer path 13D are a plurality of first vertical stacking sections 20, 23, 26, 29 and 31 and a second vertical stacking section 34. These stacking sections respectively have upper and lower stacking chambers 41A and 41B, 42A and 42B, 43A and 43B, 44A and 44B, 45A and 45B and 46A and 46B, in which bank notes of the corresponding currency values are stacked respectively. The upper stacking chambers 41A, 42A, 43A, 44A, 45A and 46A are temporary stacking chambers. The transfer path 13D is provided with gates 18, 21, 24, 27 and 30, which serve as respective inlets for the upper stacking chambers 41A, 42A, 43A, 44A and 45A of the first stacking sections 20, 23, 26, 29 and 32. These gates select bank notes P of the corresponding kinds and guide them into the respective upper stacking chambers. Below the gates 18, 21, 24, 27 and 30, vane wheels 19, 22, 25, 28 and 31 are disposed to reverse the bank notes P guided to them. No gate is provided for the second stacking section 34, which is disposed at the end of the transfer path 13D, but which is provided with a vane wheel 33. Bank notes P that have been transferred up to the end of the transfer path 13D are allowed to fall directly onto the vane wheel 33 and inverted thereby to be stacked in the temporary stacking chamber 46A. In the first stacking sections 20, 23, 26 and 29, which are arranged in the mentioned order from left to right as shown in FIG. 3, 10,000 yen, 5,000 yen, 1,000 yen and 500 yen notes, that have been transferred with a predetermined side (either front or back side) directed up, are collected respectively. In the first stacking section 32, notes which can no longer be re-used are collected. In the second stacking section 34, notes that have been transferred with the other side (either back or front side) directed up, are collected regardless of their currency values.

Figure 4:
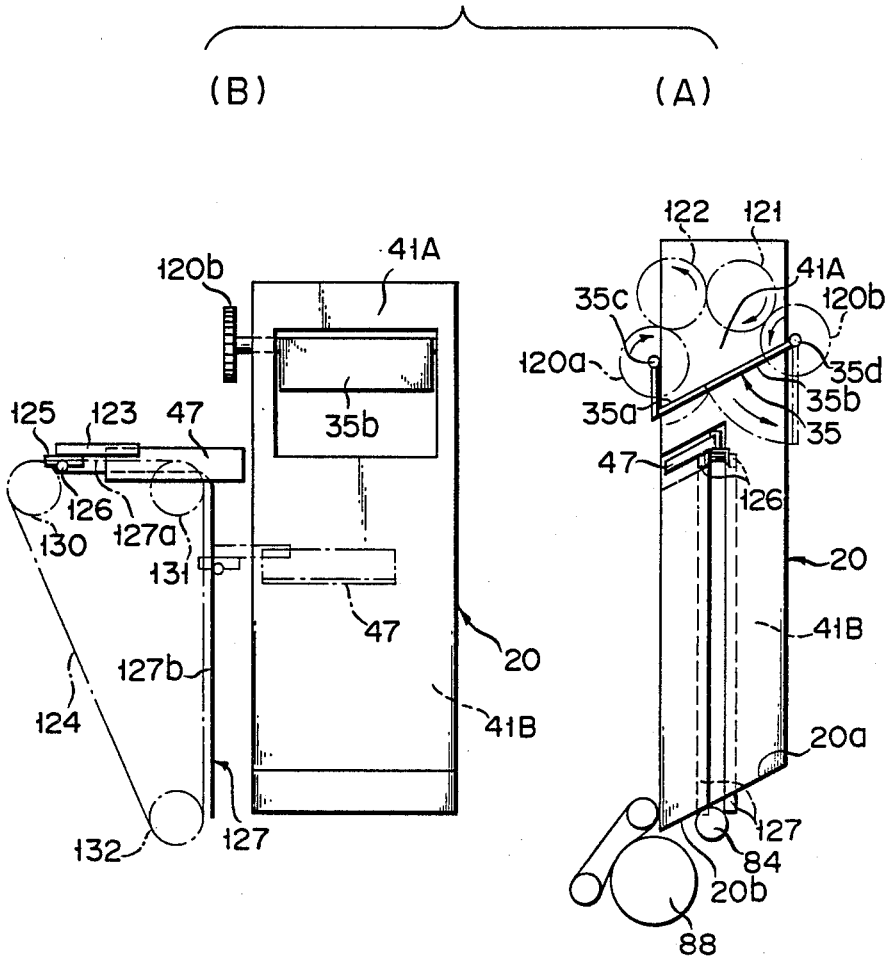
FIG. 4A is an enlarged-scale schematic view showing one of stacking sections in the mechanism of FIG. 3.
FIG. 4B is a right side view of the stacking section shown in FIG. 4A.

In the first stacking sections 20, 23, 26, 29 and 32 and second stacking section 34, respective inclined gates 35, 36, 37, 39 and 40 are provided, which can be opened when desired. These inclined gates define the upper and lower stacking chambers 41A and 41B, 42A and 42B, 43A and 43B, 44A and 44B, 45A and 45B and 46A and 46B, respectively. These inclined gates have the same construction, so only the inclined gate 35 in the first stacking section 20 will be typically described in detail with reference to FIGS. 4A and 4B. It includes openable gate members 35*a* and 35*b* mounted on respective rockable shafts 35*c* and 35*d*. The gate member 35*a* has a V-shaped profile. The shafts 35*c* and 35*d* carry respective gears 120*a* and 120*b* secured to them. These gates 120*a* and 120*b* are coupled to each other via gears 121 and 122. One of the gears 121 and 122 is a drive gear, while the other is a driven gear. In the illustrated example, the gear 121 is a drive gear and the gear 122 is a driven gear. When the drive gear 121 is rotated in the direction of the arrow in FIG. 4A, the gate members 35*a* and 35*b* are thus simultaneously opened in the manner as shown by broken lines. When the gear 121 is rotated in the opposite direction, the gate members 35*a* and 35*b* are closed simultaneously.

A back-up plate 47 is provided below the inclined gate 35. The back-up plate 47 is mounted on a free end of a holder 123 such that it is inclined and parallel with the inclined gate 35. The other end of the holder 123 is rotatably mounted on one of the links which form an endless chain 124. The bracket 125 carries rollers 126, which can roll over a substantially L-shaped guide rail 127 having an upper horizontal portion 127*a* terminating in a curved fashion to a vertical portion 127*b*. In the lower stacking chamber 41B, the back-up plate 47 can be moved vertically in its inclined and horizontally extending state due to the engagement of the rollers 126 with the guide rail 127. Thus the back-up plate 47 can be brought into engagement with the top of the stack of bank notes collected in the chamber 41B. The endless chain 124 is stretched substantially in a right triangular form round three sprocket wheels 130, 131 and 132. In FIG. 4B, the sprocket wheel 130 is a driving sprocket wheel which is coupled to a motor (not shown) via a clutch (not shown), while the other sprocket wheels 131 and 132 are driven sprocket wheels. With this arrangement, the back-up plate 47 can be brought out of the lower stacking section 41B before opening the inclined gate 35. To this end, the driving sprocket wheel 130 is driven from the motor via the clutch to drive the endless chain 124 in the counter-clockwise direction, thus causing the ascent of the back-up plate 47 mounted on the endless chain 124. When the rollers 126 mounted on the bracket 125 are moved up to the upper end of the vertical portion 127*b* of the guide rail 127, the direction of their movement is changed, and they are now moved along the horizontal portion 127*a* of the guide rail. As the rollers 126 are moved away from the stacking chamber 41B along the horizontal guide rail portion 127*a*, the back-up plate 47 is brought out of the chamber 41B to the position shown by the solid lines in FIG. 4B. After the back-up plate 47 has been shunted, the driving gear 121 may be driven in the direction of the arrow to open the gate members 35*a* and 35*b* as shown by the broken lines in FIG. 4A, thus allowing the bank notes P that have been held temporarily stacked on the inclined gate 35 to fall into the lower stacking chamber 41B. Thereafter, the gate members 35*a* and 35*b* are brought back to the initial closed state to serve as the bottom of the upper stacking chamber 41A. After the inclined gate 35 has been closed, the driving sprocket wheel 130 may be driven to drive the endless chain 124 in the clockwise direction so as to bring the back-up plate 47 into the lower stacking chamber 41B again. When the back-up plate 125 is brought into the lower stacking chamber 41B, the rollers 126 mounted on the bracket 125, which has been brought from the horizontal portion 127*a* to the vertical portion 127*b* of the guide rail 127, is now ready to move along the vertical portion 127*b*. At this time, the driving sprocket wheel 130 is decoupled from the driving motor by the clutch. The back-up plate 47 thus descends due to its own weight through the lower stacking chamber 41B while holding its horizontally extending state. The back-up plate 47 thus strikes and pushes down the stack of bank notes P on an inclined bottom 20*a* of the lower stacking chamber 41B. The urging force exerted on the bank notes P stacked in the lower stacking chamber 41B by the back-up plate helps to readily take out the notes P. The inclined gates of the other stacking sections 23, 26, 29, 32 and 34 are disposed and operated in the same manner as described above. The back-up plate as described above is also provided in the other first stacking sections 23, 26 and 29 and in the second stacking section 34. No back-up plate, however, is provided in the first stacking section 32, in which damaged notes are collected. Instead, the lower stacking chamber 45A of this section is in the form of a collecting box which can be removed by withdrawing downwards. The first stacking sections 20, 23, 26, 29 and 32 and second stacking section 34 are further provided respectively with detectors 66, 67, 68, 69, 70 and 71, each of which includes a lamp or light emitting element and a photoelectric element which detect the presence or absence of notes P on the associated inclined gate, as well as similar detectors 60, 61, 62, 63, 64 and 65 for detecting the fully stacked state of the lower stacking chambers. Similar detectors 75, 76, 77, 78 and 66 are further provided in the first stacking sections 20, 23, 26 and 29 and second stacking section 34 for detecting the presence or absence of notes P in the respective lower stacking chambers.

The bank notes P stacked in the lower stacking chambers of the first stacking sections 20, 23, 26 and 29 can be taken out one by one from the lowermost note by respective take-out rollers 84, 85, 86 and 87 and fed out by associated feed rollers 88, 89, 90 and 91. These take-out rollers and feed rollers form respective take-out and feed devices. The bank notes P can be taken out through an outlet 20*b* (FIG. 4A) which is formed in a lower part of the inclined bottom 20*a*. The back-up plate 47 is adapted to urge the bank note stack on a portion thereof corresponding to the lower end of the inclined bottom 20*a* where the outlet 20*b* is located. The urging force thus can help in taking out the bank notes P effectively. The bank notes P taken out by these take-out and feed devices are transferred by a transfer mechanism 133 comprising rollers and conveyor belts. The transfer mechanism 133 has a substantially L-shaped profile including a horizontal transfer path 133*a* and a vertical transfer path 133*b*. The bank notes are first transferred along the horizontal transfer path 133*a* and then transferred along the vertical transfer path 133*b*. A detector 82 which detects bank notes P which have been taken out and are being transferred in an overlapped state, is provided on the transfer mechanism 133 at an intermediate point thereof. Adjacent to the upper end of the vertical transfer path 133*b*, a vane wheel 134 is disposed. The vane wheel 134 can receive bank notes P from the path 133*b* and drop them into a payment note stacking section 73 disposed below it. The payment note stacking section 73 is connected to a delivery slot 93 (FIG. 1) by a conveyor 92. Bank notes P in the payment note stacking section 73 are transferred on the conveyor 92 to the delivery slot 93. Near the upper end of the vertical transfer path 133*b*, a gate 93*a* is provided. Bank notes P being transferred in the overlapped state are led by the gate 93a to an overlapped note stacking section 94 along a conveyor 135 and collected in the section 94. The stacking section 94 is located below the stacking section 73.

The bank notes P stacked as the backside notes in the lower stacking chamber 46B of the second stacking section 34 are taken out by a take-out roller 52 and fed out by a feed roller 53. The take-out roller 52 and feed roller 53 form a take-out and feed device. The backside notes taken out by this take-out and feed device are transferred by a transfer mechanism 136, which is comprised of rollers and conveyor belts, to the detecting section 14 to be sorted there again in the manner as described above. The take-out and feed device and transfer mechanism 136 form a second transfer route or return route. The transfer mechanism 136 has an L-shaped profile including a vertical transfer path 136*a* having one end coupled to the feed roller 53 and a horizontal transfer path 135*b* extending from the upper end of the vertical transfer path 136*a*.

Figure 5A:
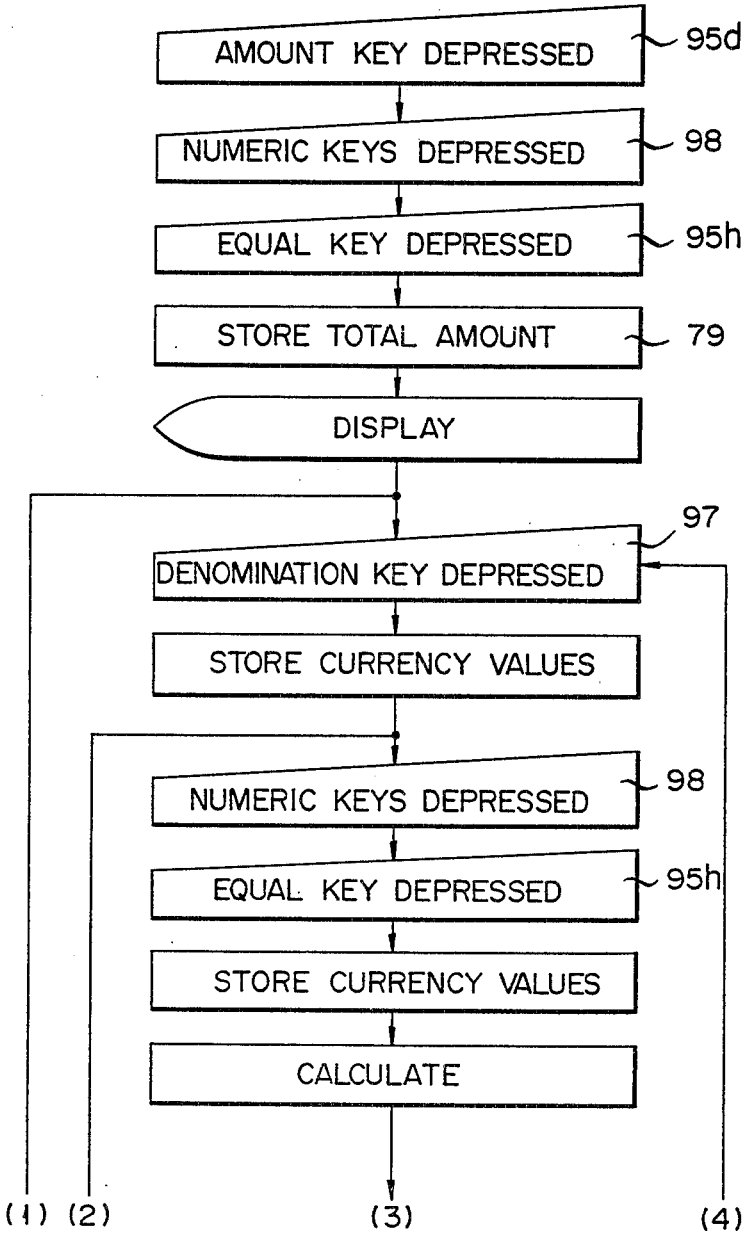
FIGS. 5A and 5B are flow charts for explaining a payment process.
Figure 5B:
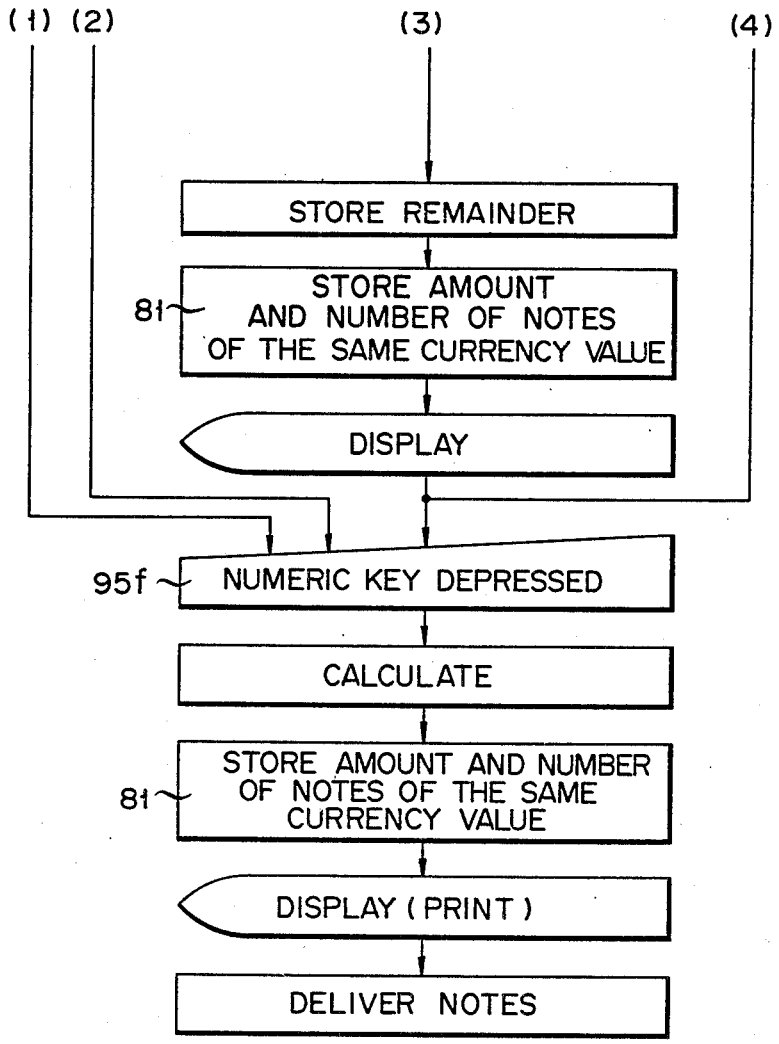
Figure 6A:
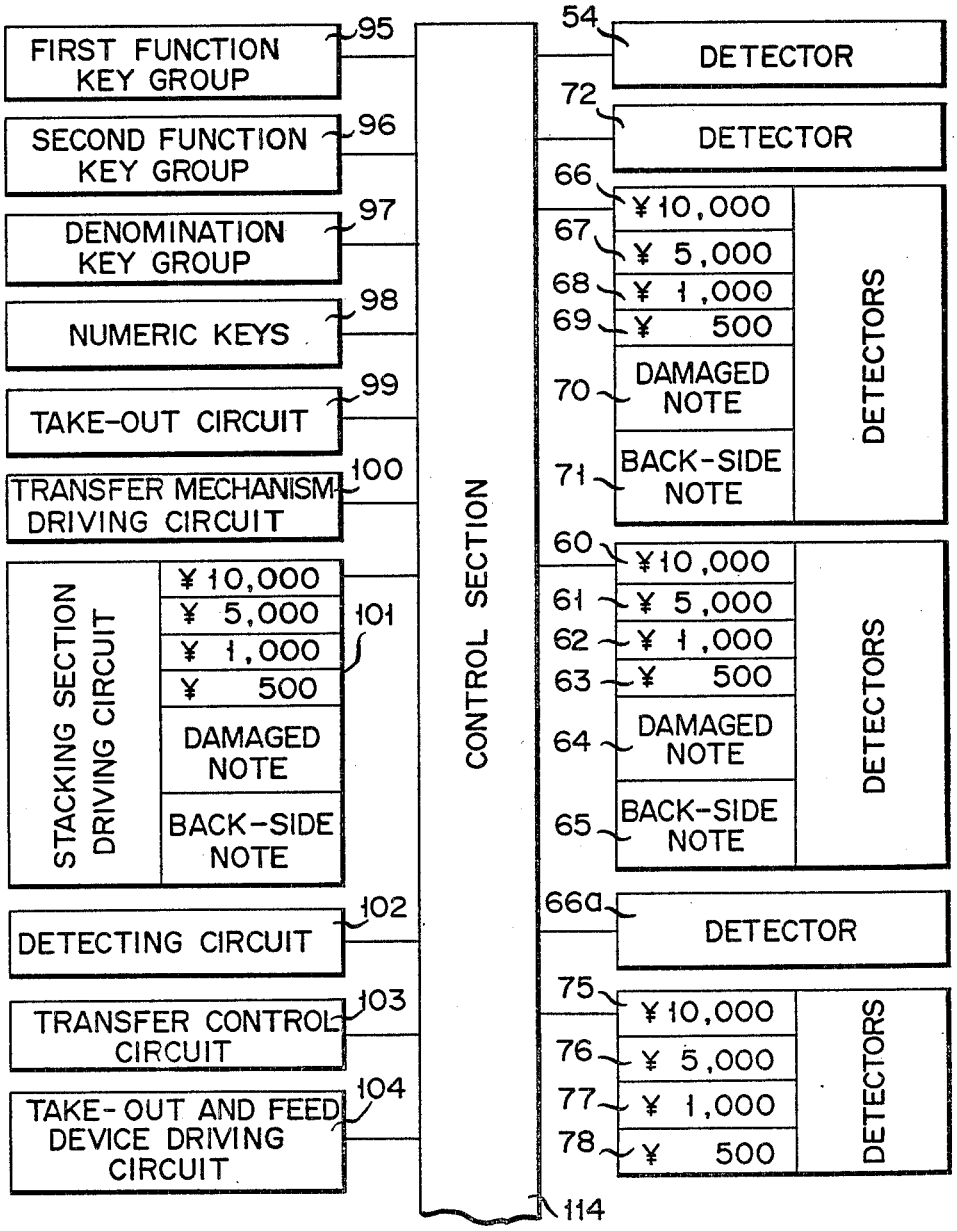
FIGS. 6A and 6B form a block diagram showing a control system for the paper sheet processing apparatus according to the invention.
Figure 6B:
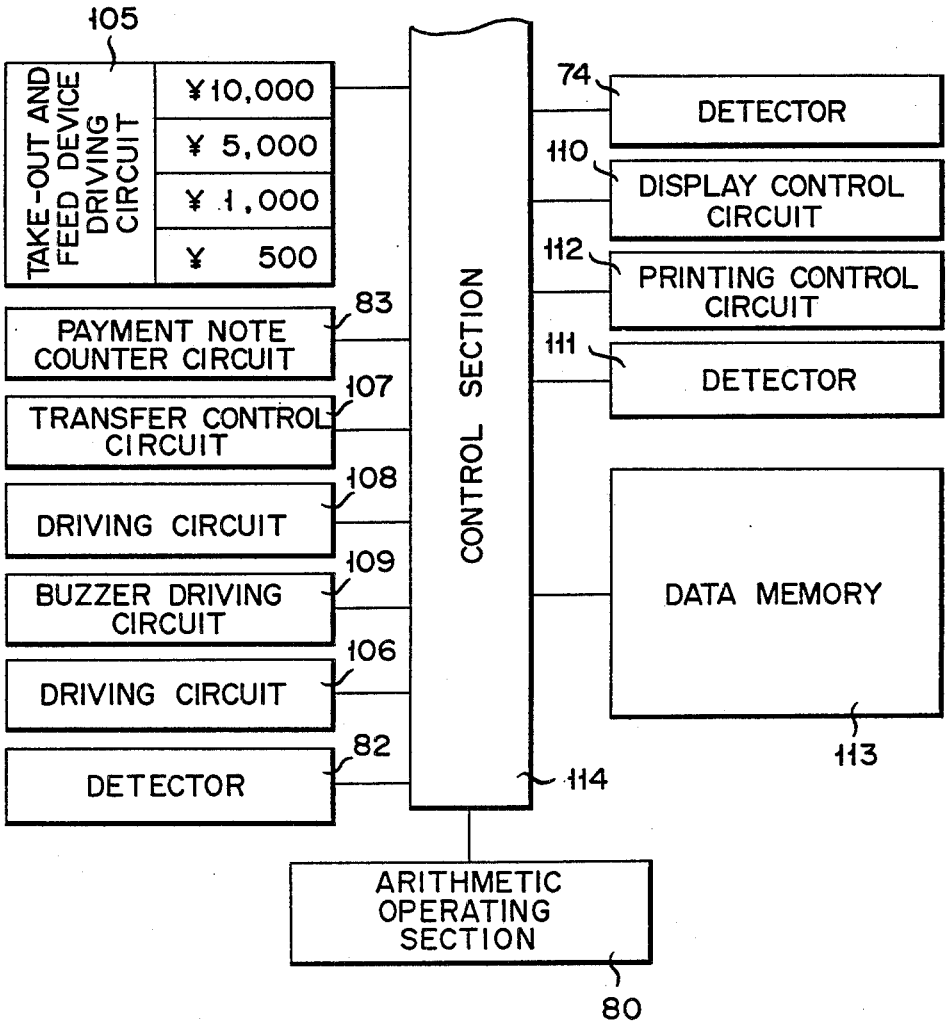

Now the operation of the apparatus will be described by referring to FIGS. 5 and 6 as well as FIGS. 1 to 4.

The receiving process will first be described. Bank notes P to be processed are set in the supply section 11, and the reception key 95*a* in the first function key group 95 is depressed. Then the count start key 96*a* in the second function key group 96 is depressed. When the presence of bank notes P in the supply section 11 is detected by the detector 54, a signal is supplied from the detector 54 to the control section 114. The transfer mechanism comprised of rollers and conveyor belts are started by a transfer mechanism driving circuit 100, when the circuit 100 receives a signal provided by the depression of the reception key 95*a*. When the count start key 96*b* is depressed, the control section 114 provides a signal to a take-out circuit 99. The take-out circuit 99, in response to the received signal, drives the take-out roller 12 and feed roller 13 in the first take-out and transfer mechanism to take out the bank notes P one by one from the supply section 11. The bank notes P taken out one by one are supplied to the belt conveyor 13A, which is driven by the transfer mechanism driving circuit 100, to the detecting section 14. In the detecting section 14, a detecting circuit 102 determines the currency values (10,000 yen, 5,000 yen, 1,000 yen and 500 yen) of the supplied bank notes. The detecting circuit 102 also checks whether the notes are normal notes (which can be re-used) or damaged notes (which cannot be re-used). Further, it counts the bank notes supplied and detects whether the bank notes are being supplied with the front or back side up. Bank notes P which are incapable of processing by the detecting circuit 102, for instance notes which are supplied in an overlapped state from the supply section 11, are led by the rejected note gate 15 to the rejected note stacking section 16. The operations described so far are controlled by the transfer mechanism driving circuit 100 and a transfer control circuit 103. The bank notes whose values are determined and counted by the detecting circuit 102 are permitted by the rejected note gate 15 to proceed toward the direction change roller 17.

When a bank note P is determined to be a normal 10,000-yen note, for instance, and has its predetermined side (either front or back side) up, it is selected by the 10,000-yen note gate 18 and allowed thereby to be collected by the vane wheel 19 into the upper stacking chamber 41A of the first stacking section 20. This operation is brought about by the transfer control circuit 103 and transfer mechanism driving circuit 100. When the control section 114 confirms that a 10,000-yen note has entered the temporary upper stacking chamber 41A, it produces a signal, which represents a number "1" corresponding to the note that has entered the chamber. This data of "1" is added to the data stored in a normal 10,000-yen note memory area of a temporary stack memory section 56 in a data memory 113 (i.e., the data representing the number of 10,000-yen notes that have been stacked in the stacking section 20). Likewise, a normal 5,000-yen note supplied with its predetermined side up is allowed by the 5,000-yen note gate 21 to be collected by the vane wheel 22 into the upper stacking chamber 20A of the first stacking section 23. When this is confirmed, the corresponding data stored in the temporary stack memory section 56 is similarly renewed. Similarly, a normal 1,000-yen or 500-yen note supplied with their predetermined side up is allowed by the gate 24 or 27 to be collected by the vane wheel 25 or 28 into the upper stacking chamber 43A or 44A in the first stacking section 26 or 29 and the corresponding temporary stack data is renewed. A damaged note supplied with the predetermined side up is selected by the gate 30 regardless of its currency value. It is thus allowed to be collected by the vane wheel 31 into the damaged note stacking section 32. At this time, however, the control section 114 controls the number "1" signal therefrom to be stored in a corresponding damaged note memory area of the temporary stack memory section 56. A bank note which is supplied with the side other than the predetermined side up (i.e., a backside note) is collected by the vane wheel 33 into the upper stacking chamber 46A of the second stacking section 34 regardless of its currency value and also regardless of whether it is a normal or damaged note. The number "1" signal that is produced at this time is stored in a corresponding currency value backside note memory area of the temporary stack memory section 56. In the above way, the bank notes P detected by the detecting circuit 102 in the detecting section 14, among the bank notes take out from the supply section 11, are sorted and stacked in the upper stacking chambers 41A, 42A, 43A, 44A, 45A and 46A of the corresponding stacking sections 20, 23, 25, 28, 32 and 34. Also, the currency amounts and the number of individual currency value notes stacked are stored in the temporary stack memory section 56. When the absence of any bank note in the supply section 11 is detected by the detector 54, which may consist of a lamp and a photoelectric element, the control section 114 provides an instruction for stopping the take-out roller 12 and a feed roller 13 to the take-out and feed device driving circuit 99. If at this time there are bank notes in the rejected note stacking section 16 and/or if there are additional bank notes to be processed, they may be also processed in the manner as described above. More particularly, they are set in the supply section 11, and the count start key 96*b* in the second function key group 96 is depressed, whereby these bank notes are sorted and counted in the same way. After any bank notes stacked in the rejected note stacking section 16 and/or any additional bank notes have been sorted and stacked in the pertinent upper stacking chambers, a store key 95*e* in the first function key group 95 may be depressed. As a result, a signal is given to a stacking section driving circuit 101 to cause the circuit 101 to open the inclined gates 35, 36, 37, 38, 39 and 40 constituting the bottoms of the upper stacking chambers 41A, 42A, 43A, 44A, 45A and 46A of the first stacking sections 20, 23, 26, 29 and 32 and second stacking section 34. Before opening the inclined gates 35, 36, 37, 38, 39 and 40, the stacking section driving circuit 101 causes the back-up plates 47, 48, 49, 50 and 51 to be moved out of the respective lower stacking chambers 41B, 42B, 43B, 44B and 46B of the stacking sections to their uppermost shunted position, so that these back-up plates will not interfere with the bank notes falling into the lower stacking chambers. After a predetermined period of time, the inclined gates 35, 36, 37, 38, 39 and 40 are closed. Thereafter, the back-up plates 47, 48, 49, 50 and 51 are introduced into the respective lower stacking chambers 41B, 42B, 43B, 44B and 46B again to urge the bank note stacks therein from above.

In the meantime, when the store key 95*a* in the first function key group 95 is depressed, the total amounts of the individual currency value bank notes inclusive of damaged and backside notes and the sum thereof are calculated in an arithmetic operating section 80 from the data stored in the temporary stack memory section 56 of the data memory 113. The results are displayed on the display section 3 under the control of a display control circuit 110. Also they are printed in the printing section 5 under the control of a printing control circuit 112. The resultant data are added to data stored in a received amount memory section 115. Further, the data stored in a currency value note stack memory section 57, a damaged note stack memory section 58 and a backside note stack memory section 55 are renewed according to the corresponding data in the temporary stack memory section 56. When the renewal of the data contents of the received amount memory section 115, currency value note stack memory sections 57, damaged note stack memory section 58 and backside note stack memory section 55 is completed, the contents of the temporary stack memory section 56 are cleared under the control of a signal supplied from the control section 114.

Now, the backside note sorting process will be described. In the first place, a backside note sort key 95*c* in the first function key group 95 is depressed. As a result, a signal representing the presence of backside bank notes in the lower stacking chamber 46B is supplied from a detector 66*a* to the control section 114. The control section 114 thus causes a backside note take-out and feed device driving circuit 104 to drive the take-out roller 52 and feed roller 53. When the backside note sort key 95*c* in the first function key group 95 is depressed, the transfer mechanism driving circuit 100 is also caused to drive the transfer mechanism 136 comprised of rollers and conveyor belts. Thus, the backside bank notes taken out one by one by the take-out roller 52 and feed roller 53 are supplied, after insertion, i.e., with the predetermined side up, to the detecting section 14. In the detecting section 14, the detecting circuit 102 detects the currency values of the supplied bank notes and also detects whether the notes are normal or damaged notes as in the case of the receiving process. Bank notes which are supplied in the overlapped state and incapable of detection, are again led by the rejected note gate 15 to the rejected note stacking section 16. The rejected bank notes collected in the rejected note stacking section 16 are supplied to the supply section 11 for processing once again. The bank notes that are detected by the detecting circuit 102 in the detecting section 14 are temporarily stacked in the upper stacking chambers 41A, 42A, 43A, 44A and 45A of the pertinent stacking sections 20, 23, 26, 29 and 32. Also, every time a bank note enters any of these upper stacking chambers, its entrance is memorized in the temporary stack memory section 56. When a signal representing the absence of any backside bank note in the lower stacking section 46B is provided from the detector 66*a*, the control section 114 produces a signal to render the backside note take-out and feed device inoperative. As a result, the take-out roller 52 and feed roller 53 are stopped. Thereafter, any rejected bank notes that have been collected in the rejected note stacking section 16 are taken out and set in the supply section 11 again, and then the count start key 96*b* in the second function key group 96 is depressed again, whereby these bank notes can be sorted and stacked in the pertinent stacking sections 20, 23, 26, 29 and 32. After all of the backside bank notes have been sorted and counted, the store key 95*e* in the first function key group 95 is depressed. As a result, the data content in the backside note stack memory section 55 and the corresponding data in the temporary stack memory section 56 are compared by the control section 114. If both the memory contents coincide, the inclined gates 35, 36, 37, 38 and 39 are opened, allowing the bank notes to be stored in the lower stacking chambers 41B, 42B, 43B, 44B and 45B. Again at this time, the previous data stored in the currency value note stack memory section 57, and damaged note stack memory section 58 are renewed by the arithmetic operating section 80 according to the newly data stored in the temporary stack memory section 56. Further, when the data renewal is effected, the contents of the temporary stack memory section 56 and the content of the backside note stack memory section 55 are cleared. In the backside note sorting process, the contents of the received amount storage section 115 in the data memory 113 are not renewed.

In case the data of the backside note stack memory section 55 and the corresponding data content of the temporary stack memory section 56 do not coincide, the control section 114 provides a signal to a buzzer driving circuit 109 to warn the operator of the non-coincidence by operating a buzzer (not shown). At the same time, the non-coincidence is displayed on the display section 3 under the control of the display control circuit 110. The operator thus can confirm the non-coincidence without failure. In this case, after depressing a buzzer stop key 96*e* in the second function key group 96, the bank notes stacked in the upper stacking chambers 41A, 42A, 43A, 44A and 45A in the stacking sections 20, 23, 26, 29 and 32 are taken out and set in the supply section 11 again, and then a release key 95*i* in the first function key group 95 is depressed. As a result, the data contents in the temporary stack memory section 56 are cleared. Thereafter, the count start key 96*b* is depressed to start sorting and counting once again. The data stored in the temporary stack memory section 56 as a result of this operation are compared again with the data in the backside note stack memory section 55. If coincidence of data is obtained at this time, the inclined gates 35, 36, 37, 38 and 39 are opened as in the previous case, allowing the bank notes to be stored in the lower stacking chambers 41B, 42B, 43B, 44B and 45B, while the previous data in the currency value note memory sections 57 and damaged note memory section 58 are renewed according to the newly stored data in the temporary stack memory section 56. With this coincidence, a backside note arrangement non-coincidence circuit 118 in the data memory 113 is cleared.

If non-coincidence results again, it is confirmed in the non-coincidence memory which is provided in the backside note arrangement non-coincidence circuit 118 in the data memory 113. In this case, the data in the backside note stack memory section 55 and in the temporary stack memory section 56 are printed in the printing section 5 under the control of the printing control circuit 112 in response to a signal from the control section 114. A printed data sheet thus obtained may be stored together with the bank notes that were stacked in the stacking chambers 41B, 42B, 43B, 44B and 45B for the purpose of subsequent checking. In the case of the repeated occurrence of non-coincidence, the bank notes are removed from the stacking chambers 41B, 42B, 43B, 44B and 45B, and then the release key 95*i* in the first function key group 95 is depressed, whereby the backside note stack memory section 55 and temporary stack memory section 56 as well as the backside note arrangement non-coincidence memory 118 are cleared. When these memories are cleared, it is ready to proceed to the next processing.

In the receiving process or in the backside note sorting process, when one of the stacking chambers 41B, 42B, 43B and 44B becomes full of stacked bank notes, this is detected by the corresponding one of the full stack detectors 60, 61, 62 and 63, each of which is comprised of a lamp and a photoelectric element. The detector that detects the full stack provides a full stack signal to the control section 114. The control section 114 controls the transfer control circuit 103 to let the fully stacked bank notes be transferred to the damaged note stacking section 32. When the full stack detector 64 of the damaged note stacking section 45B detects the full stack, the control section 114, receiving the full stack signal from the detector 64, supplies a signal to the buzzer circuit 109 to warn the operator of the full stack. At the same time, the full stack in the damaged note stacking section 45B is displayed on the display section 3 under the control of the display control circuit 110. Thus the operator is informed of the necessity of replacing the damaged note stacking box 45B. When the damaged note stacking box 45B is removed, a signal indicating the fact that the damaged note stacking box 45B has been removed, is supplied from a detector 111, which detects this fact, to the control section 114. In response to this signal, the printing control circuit 112 is driven to print the data in the damaged note memory section 58 in the printing section 5. A printed data sheet which is thus obtained may be stored together with the removed damaged note stacking box 45B full of damaged notes, so that it may be utilized when arranging these damaged notes in order. When the data in the damaged note stacking section 58 has been printed in the printing section 5, the data stored in the damaged note memory section 58 in the data memory 113 are cleared in response to a signal provided from the control section 114, which signal is in turn provided in response to a signal provided from the printing control circuit 112.

When the full stack detector 65 of the backside note stacking chamber 46B detects the full stack in this chamber, the buzzer driving circuit 109 drives the buzzer to warn the operator of the full stack, while at the same time the full stack of the backside notes is displayed on the display section 3 under the control of the display control circuit 110. The operator can thus recognize the necessity of effecting the backside note sorting process. The control section 114 has an interlock function that prevents the receiving process when the full stack warning is made although the payment process can be made when this warning is made. That is, when the warning is produced by the buzzer and on the display section 3, the payment process may be executed after stopping the buzzer by depressing the buzzer stop key **96*e* in the second function key group 96. However, if the reception key 95*a* in the first function key group 95 is subsequently depressed for the receiving process, the warning of the full stack in the backside note stacking chamber 46B is given again by the buzzer and on the display section 3**. Therefore, the receiving process cannot be made unless the backside note sorting process has been made.

When the reception key **95*a* in the first function key group 95 is depressed for the receiving process or when the backside note sort key 95*c* in this key group 95 is depressed for the backside note sorting process, unless the absence of any bank notes in the upper stacking sections 41A, 42A, 43A, 44A, 45A and 46A in all the stacking sections 20, 23, 26, 29, 32 and 34 is detected by the respective detectors 66, 67, 68, 69, 70 and 71, the control section 114 will not provide a driving signal to the take-out and feed device driving circuit 104, so that bank notes in the supply section 11 or banknotes in the backside note stacking chamber 46B will not be taken out. If any detector detects the presence of any bank notes, the control section 114 provides a signal to the buzzer driving circuit 109 and to the display control circuit 110 to let the operator be informed of this fact by the buzzer and on the display section 3. When this warning is given by the buzzer and displayed, the trouble in the displayed locality must be removed. Then, the release key 95*i* in the first function key group 95 is depressed, allowing the receiving process or backside note sorting process to be started by depressing the reception key 95*a* or backside note sort key 95*c* in the first function key group 95** again.

The payment process will now be described. For this process, a delivery key **95*b* in the first function key group 95 is depressed. When the delivery key 95*b* is depressed, the detector 74 in the payment stacking section 73 is operated to check whether there is any bank note in the payment stacking section 73. If the detector 74 detects bank notes in the payment stacking section 73, it supplies a signal to the control section 114. The control section 114, receiving this signal, causes the buzzer driving circuit 109 and display control circuit 110 to warn the operator of this fact by the buzzer and on the display section 3. When this warning by the buzzer and display is given, it is necessary to empty the payment stacking section 73. Then the release key 95*i* in the first function key group 95 is depressed. The payment process now can be started by depressing the delivery key 95*b* again. When the delivery key 95*b* in the first function key group 95 is depressed, not only the detection of the presence or absence of bank notes in the payment stacking section 73 is made, but also it is confirmed by the residual note detectors 75, 76, 77 and 78 that sufficient 10,000-yen, 5,000-yen, 1,000-yen and 500-yen notes are contained in the respective stacking chambers 41B, 42B, 43B and 44B. If any detector detects that bank notes in the corresponding stacking chamber are insufficient, the control section 114 again provides a signal to the buzzer driving circuit 109 and to the display control circuit 110 to warn the operator of this fact by the buzzer and on the display section 3. When this warning is given, the operator has to provide the sufficient bank notes. This is done so by depressing the release key 95*i* in the first function key group 95 and executing the receiving process or backside note sorting process. When the payment stack note detector 74 detects absence of any bank note in the payment stacking section 73 while all the residual note detectors 75, 76, 77 and 78 detect that sufficient bank notes are stacked in the associated lower stacking chambers, an amount of payment now can be specified. To enter the payment amount, an amount key 95*d* in the first function key group 95 is depressed, and then the amount data are keyed in from the higher digits by operating the numeric keys 98. Finally, an equal key 95*h* is depressed. In this way, the total amount of payment is specified. This input data is stored in a total amount memory 79 of a payment memory section in the data memory 113. The input data is also displayed on the display section 3 under the control of the display control circuit 110 in response to a signal supplied from the control section 114. If no currency value kind of notes is specified, that is, if payment in the least number of bank notes is desired, a payment key 95*f* in the first function key group 95 is depressed. As a result, the control section 114 causes the arithmetic operating section 80 to calculate the amounts and numbers of individual currency value notes necessary for this payment from the data stored in the total amount memory area 79. The results of calculations are stored in a payment currency value note memory section 81 and are also displayed on the display section 3 under the control of the display control circuit 110. At the same time, payment bank notes are taken out from the lower stacking chambers 41B, 42B, 43B and 44B according to the data stored in the payment currency value note memory section 81. More particularly, the control section 114 causes a payment note take-out and feed device driving circuit 105 to successively drive the take-out rollers 84, 85, 86 and 87 and feed rollers 88, 89, 90 and 91 for the respective lower stacking chambers 41B, 42B, 43B and 44B according to the data stored in the payment currency value note memory section 81. The bank notes of each of the different currency values are taken out one by one by the corresponding take-out roller and feed roller. These bank notes taken out are checked for overlap take-out by the detector 82. Unless overlapped bank notes are detected, the pertinent take-out roller and feed roller are driven continuously until the bank notes corresponding in number to the relevant currency value note number data stored in the payment currency value note memory section 81 are taken out. When a payment note counter circuit 83 detects the coincidence of the number of the taken-out bank notes and the corresponding number data in the payment currency value note memory section 81, a signal for discontinuing the take-out of bank notes of this currency value is supplied to the payment note take-out and feed device driving circuit 105, so that the pertinent take-out roller and feed roller are stopped. Then the bank notes of the next currency value are taken out according to the corresponding number data stored in the payment currency value note memory section 81. When all the payment bank notes have been taken out according to the amount and number data for the individual currency value notes stored in the payment currency value note memory section 81 and are stacked in the payment note stacking section 73, a delivery driving circuit 108 is caused to bring these bank notes on the conveyor 92 to the delivery slot 93. When the delivery is confirmed, the data displayed on the display section 3, i.e., the data in the payment currency note memory section 81 and in the total amount memory area 79, is printed in the printing section 5 under the control of the printing control circuit 112. When the delivery and printing are effected, the data stored in the payment memory section 116 is renewed by the arithmetic operating section 80 according to the data stored in the total amount memory area 79 and payment currency value note memory section 81. When the data of the payment memory section 79 is renewed, the payment currency value note memory section 81 is cleared. From the data contents in a currency value note stack memory section 57, data from the payment counter circuit 83** are subtracted.

When overlapped bank notes are detected by the detector 82, a payment note transfer control circuit 107 controls a transfer mechanism driving circuit 106 such that the detected overlapped bank notes are directed by the gate 93*a* to the overlapped note stacking section 94.

For specifying desired currency value kinds of payment bank notes, 10,000-yen, 5,000-yen, 1,000-yen and 500-yen keys in the denomination key group 97 are selectively depressed as desired. More particularly, when payment in bank notes of a desired currency value is desired, after entering the total amount of payment the relevant currency value key is depressed. Then the payment key 95*f* in the first function key group 95 is depressed. As a result, the control section 114 causes arithmetic operating section 80 to calculate the number of bank notes of the specified currency value kind necessary for the payment from the data stored in the total amount memory area 79. The data of the calculated number of bank notes as well as the total amount of payment, is stored in the pertinent area of the payment note data memory section 81. These data are also displayed on the display section 3 under the control of the display control circuit 110. The delivery in this case is effected in the same manner as in the case of payment in the least number of bank notes as described previously. Also, the printing of the displayed data in the printing section 5 and the renewal of the payment memory section 116 are renewed according to the data of the payment amount this time are effected concurrently with the delivery, as in the case of the payment in the least number of bank notes.

Further, it is possible to specify one currency value for part of the total amount and the least number of bank notes for the rest. In this case, after entering the total amount of payment the desired currency value is specified by depressing the corresponding key in the key group 97, and the amount of payment that is desired in the specified currency value notes is entered with the numeric keys 98. Then the payment key 95*f* in the first function key group 95 is depressed. As a result, the arithmetic operating section 80 is caused to first calculate the number of bank notes of the specified currency value corresponding to the specified amount. This note number data is stored together with the corresponding amount data in the pertinent currency value note memory area of the payment currency value note memory section 81. The control section 114 then gives an instruction to the arithmetic operating section 80 to subtract the data stored in the payment currency value note memory section 81 from the data in the total amount memory area 79 and then calculate the amounts and number of bank notes of currency value kinds other than the specified one, i.e., other than the currency value kind stored in the payment currency value note memory section 81, necessary for the balance. The results of calculations are stored in the payment currency value note memory section 81 in response to an instruction from the control section 114. The data stored in the payment currency value note memory section 81 are also displayed on the display section 3 under the control of the display control circuit 110. The delivery of the amount stored in the payment currency value note memory section 81 is again effected in the manner as described before in connection with the case of payment in the least number of bank notes. Further, the data in the payment currency value note memory section 81 and in the total amount memory area 79 are printed in the printing section 5 concurrently with the delivery. Also, the payment memory section 116 is renewed according to the data in the payment currency value note memory section 81 and total amount memory area 79. When the content of the payment memory section 116 is renewed, the payment currency value note memory section 81 and total amount memory area 79 are cleared.

The data from the payment counter circuit 83 have been subtracted from the data stored in the currency value note stack memory section 57. That is, the data in the currency value note stack memory section 57 at this moment corresponds to the sums of the amounts and numbers of bank notes stored in the lower stacking chambers 41B, 42B, 43B and 44B in the respective stacking sections and the amounts and numbers of bank notes collected in the overlapped note stacking section 94.

The transfer mechanisms for the receiving process or backside note sorting process and for the payment process are provided separately. That is, they comprise respectively independent transfer mechanism driving sections (i.e., the transfer mechanism driving circuit 100 and payment note transfer mechanism driving circuit 106) and transfer control circuits (i.e., the transfer control circuit 103 and payment note transfer control circuit 107). Thus, the receiving or backside note sorting process and payment process can be executed concurrently. However, the control section 114 is adapted to permit the store operation (caused by depressing the store key 95*e* in the first function key group 95) in the receiving or backside note sorting process only after the payment process has ended.

A reference key 96*c* in the second function 96 can not be operated unless the receiving process, backside note sorting process or payment process is in force. When the reference key 96*c* is depressed while none of the processes is in force, the data in the data memory 113, i.e., the data in the reception memory section 115, payment memory section 116, currency value note stack memory section 57 and damaged note memory section 58, are displayed on the display section 3 under the control of the display control circuit 110. Further, by depressing the print key 96*d* after the reference key 96*c*, the data of the data memory 113, as displayed on the display section 3, can be printed in the printing section 5 under the control of the printing control circuit 112.

The embodiment described in the foregoing is given for the purpose of illustration only, and various changes and modifications can be made in the details of design of the individual component parts without altering the functions thereof. For example, the second stacking section 34 may be disposed at any desired location other than that at the end of the transfer path 13D, as well. At any rate, however, it is desirable to dispose the individual stacking sections vertically and in parallel below the horizontal transfer path 13D. The disposition of each of the transfer mechanisms 133 and 136 in an L-shaped fashion to surround a respective stacking section, is effective for providing a compact construction.

It is to be emphasized that the construction according to the invention essentially comprises a first stacking section group including first stacking sections for collecting paper sheets of like kinds supplied with a predetermined surface facing in a preselected direction and a single second stacking section for collecting paper sheets each with the surface other than the predetermined surface directed towards the preselected direction regardless of the kind. The transfer mechanism constituting the return route from the second stacking section and the transfer mechanism constituting the forward route from each of the first stacking sections to the payment note stacking section are immaterial according to the invention.

The most important effect of the paper sheet processing apparatus according to the invention is that rapid sorting of the paper sheets is obtainable. In addition, the apparatus is less prone to malfunctions, highly reliable and can be manufactured compactly and inexpensively.

What we claim is:

1. An apparatus for processing paper sheets, having respective first and second surfaces, comprising:

a paper sheet supply section in which paper sheets to be processed are loaded without regard to which direction the first surface or second surface is facing;

a detecting section for checking whether the first or second surface of each paper sheet is facing in a preselected direction and for identifying the kind of each paper sheet;

paper sheet take-out and feed means for taking out paper sheets one by one from said paper sheet supply section and feeding them toward said detecting section;

a first stacking section group including a plurality of first stacking sections, each said first stacking section for collecting like kinds of paper sheets having said first surface facing in the preselected direction;

a second stacking section for collecting all kinds of paper sheets having their respective second surfaces facing the preselected direction;

paper sheet transfer path means extending from said detecting section to said first stacking section group and said second stacking section; and sorting gate means for selectively leading the paper sheets having been passed through said detecting section to the first stacking sections in said first stacking section group and said second stacking section according to the result of determination effected in said detecting section.

2. The apparatus for processing paper sheets having respective first and second surfaces, comprising:

a paper sheet supply section in which paper sheets to be processed are loaded without regard to which direction the first and second surfaces are facing;

a detecting section for checking whether the first or second surface of each said paper sheet is facing in a preselected direction, identifying damaged paper sheets from undamaged ones and identifying paper sheets according to like kinds of sheets;

paper sheet feeding means for feeding paper sheets one by one from said paper sheet supply section to said detecting section;

a plurality of first stacking sections each for collecting undamaged paper sheets of a like kind with the first surfaces facing in the preselected direction;

a second stacking section for collecting paper sheets with the second surfaces facing in the preselected direction, regardless of the kind and the condition;

a third stacking section for collecting damaged paper sheets having a predetermined one of said first or second surfaces facing the preselected direction, regardless of the kind; and sorting gate means for feeding each said paper sheet from said paper sheet feeding means to one of said first collecting sections, said second collecting section or said third collecting section in accordance with the determination of said detecting section.

3. The apparatus for processing paper sheets according to claim 1 or 2, which further comprises:

return paper sheet transfer path means connected at one end to said second stacking section and connected at the other end to said detecting section, for taking out the paper sheets stacked in said second stacking section and feeding the taken-out paper sheets, after reversing the position of said surfaces such that said first surfaces are facing in the preselected direction, back to said detecting section for identification of the kind once again.

4. The apparatus for processing paper sheets according to claim 3, wherein said return paper sheet transfer path means includes rollers and conveyor belts.

5. The apparatus for processing paper sheets according to claim 3, which further comprises:

counting means for counting each kind of paper sheet being processed; and memory means for storing data representing the number of each kind of paper sheet stacked in said second stacking section and also storing data representing the number of each kind of paper sheet removed from said second stacking section and sorted again.

6. The apparatus for processing paper sheets according to claim 5, wherein each of said first stacking sections is vertically disposed and consists of an upper stacking chamber and a lower stacking chamber and said memory means includes a first counter memory section for storing the data representing the number of paper sheets with said second surface facing in the preselected direction and a second counter memory section for storing the data representing the number of paper sheets processed to be sorted once again, whereby the paper sheets in said upper stacking chambers in the first stacking sections are transferred to said lower stacking chambers therein when the data stored in said first and second counter memory sections coincide.

7. The apparatus for processing paper sheets according to claim 1 or 2, which further comprises:

a delivery paper sheet stacking section for collecting paper sheets to be delivered through a delivery outlet of said processing apparatus, said delivery paper sheet stacking section being coupled to said delivery outlet; and delivery paper sheet take-out and feed means connected at one end to said first stacking sections and connected at the other end to said delivery paper sheet stacking section, for taking out paper sheets stacked in said first stacking sections and feeding the taken-out paper sheets into said delivery paper sheet stacking section.

8. The apparatus for processing paper sheets according to claim 1, wherein each said first stacking section in said first stacking section group is disposed vertically and in parallel with the other said first stacking sections and each said first stacking section includes an upper temporary stacking chamber and a lower stacking chamber.

9. The apparatus for processing paper sheets according to claim 1, wherein said second stacking section is disposed vertically and includes an upper temporary stacking chamber and a lower stacking chamber.

10. The apparatus for processing paper sheets according to claim 2, wherein said third stacking section is vertically disposed and consists of an upper stacking chamber and a lower stacking chamber.

11. The apparatus for processing paper sheets according to claim 8, 9 or 10, wherein each said upper stacking chamber includes an inclined gate constituting a bottom and consisting of a pair of normally closed, openable gate members.

12. The apparatus for processing paper sheets according to claim 8, 9 or 10, wherein each said lower stacking chamber includes an inclined bottom stacking surface and a movable back-up plate capable of entering the lower stacking chamber and engaging the top of paper sheets stacked in the lower stacking chamber to downwardly urge said stack of paper sheets.

13. The apparatus for processing paper sheets according to claim 12, wherein said inclined bottom of the lower stacking chamber includes, in its portion adjacent to its lower end, an outlet opening for taking out stacked paper sheets therethrough, said back-up plate being located to urge said stack of paper sheets on a portion thereof corresponding to said lower end side of said inclined bottom.

14. The apparatus for processing paper sheets according to claim 1 wherein:

said paper sheet transfer path means extends substantially horizontally;

each said first stacking section in said first stacking section group is disposed vertically and in a spaced-apart relation to the other first stacking sections, below said horizontal paper sheet transfer path means; and said second stacking section is disposed, vertically and parallel to said first stacking section group, below said horizontal paper sheet transfer path means.

15. The apparatus for producing paper sheets according to claim 14, which further comprises:

return paper sheet transfer path means connected at one end to the lower end of said second stacking section and connected at the other end to said detecting section and having a substantially L-shaped form including a substantially vertical transfer path and a substantially horizontal transfer path, for transferring the paper sheets stacked in said second stacking section, after reversal of said surfaces such that said first surface faces in said preselected direction, to said detecting section for identification of the kind once again.

16. The apparatus for processing paper sheets according to claim 15, which further comprises:

a delivery paper sheet stacking section for collecting paper sheets to be delivered through a delivery outlet of said processing apparatus, said delivery paper sheet stacking section being coupled to said delivery outlet; and delivery paper sheet take-out and feed means connected at one end to said first stacking section group and connected at the other end to said delivery paper sheet stacking section, for taking out paper sheets stacked in said first stacking section group and feeding the taken out paper sheets into said delivery paper sheet stacking section;

said delivery paper sheet take-out and feed means having a substantially L-shaped form including a substantially vertical transfer path and a substantially horizontal transfer path, said substantially horizontal transfer path extending below said first stacking section group.

* * * * *